US007327213B2

(12) United States Patent
Martin et al.

(10) Patent No.: US 7,327,213 B2
(45) Date of Patent: Feb. 5, 2008

(54) ENCAPSULATED FUSE WITH CORONA SHIELD

(75) Inventors: Donald R. Martin, New Lenox, IL (US); Mohammad Shooshtarizadeh, Lockport, IL (US)

(73) Assignee: G & W Electric Co., Blue Island, IL (US)

( * ) Notice: Subject to any disclaimer, the term of this patent is extended or adjusted under 35 U.S.C. 154(b) by 0 days.

(21) Appl. No.: 10/958,578

(22) Filed: Oct. 5, 2004

(65) Prior Publication Data

US 2005/0077994 A1 Apr. 14, 2005

Related U.S. Application Data

(60) Provisional application No. 60/510,265, filed on Oct. 10, 2003.

(51) Int. Cl.
*H01H 85/175* (2006.01)
*H01H 85/042* (2006.01)
*H01B 17/44* (2006.01)

(52) U.S. Cl. ..... 337/199; 337/224; 174/127

(58) Field of Classification Search ..... 337/159, 337/185–187, 199, 224, 295; 361/816, 818; 174/127, 140 CR; 439/934; 310/196
See application file for complete search history.

(56) References Cited

U.S. PATENT DOCUMENTS 1,930,804 A 10/1933 Hart
1,954,037 A 4/1934 Bowie
2,877,322 A 3/1959 Harner
3,015,008 A 12/1961 Chabala et al.
3,548,070 A * 12/1970 Duenke ..... 174/12 BH
3,559,141 A 1/1971 Hardy
3,578,896 A 5/1971 Lynch
3,684,995 A 8/1972 Horton, III
3,727,108 A 4/1973 Westrom
3,781,745 A 12/1973 Vadnagara
3,783,181 A 1/1974 Martincic et al.
3,818,407 A 6/1974 Edgerton
3,946,351 A 3/1976 Bronikowski et al.
3,955,167 A 5/1976 Kumbera
4,059,816 A 11/1977 Bonecutter et al.
4,060,785 A 11/1977 Hanke et al.
4,136,339 A 1/1979 Kuhn (Continued)

FOREIGN PATENT DOCUMENTS

GB 2256092 A * 11/1992

OTHER PUBLICATIONS

International Search Report, PCT/US04/32681, dated Feb. 18, 2005.

*Primary Examiner*—Anatoly Vortman
(74) *Attorney, Agent, or Firm*—Michael Best & Friedrich LLP

(57) ABSTRACT

An encapsulated fuse for power distribution systems and method for producing such fuses is provided. A fuse includes a body with opposing terminals. A corona shield is generally coaxial with the fuse and substantially extends the full length of the fuse body. The corona shield is electrically coupled at its first end with a first fuse terminal. The second end of the corona shield has a slightly larger cross-section than the first end to provide electrical isolation from the second fuse terminal. The fuse and attached corona shield are molded in an encapsulating material.

15 Claims, 3 Drawing Sheets

U.S. PATENT DOCUMENTS 4,419,651 A 12/1983 Leach
4,508,414 A * 4/1985 Kusui et al. ..... 439/610
5,386,345 A * 1/1995 Matsuzaki et al. ..... 361/816
5,473,113 A * 12/1995 Aldissi ..... 174/36
5,903,209 A 5/1999 Stepniak

* cited by examiner

ENCAPSULATED FUSE WITH CORONA SHIELD

CROSS-REFERENCE TO RELATED APPLICATION

This application claims the benefit of U.S. Provisional Patent Application No. 60/510,265, filed Oct. 10, 2003.

FIELD OF THE INVENTION

The present invention pertains to current interrupting devices. More particularly, the present invention relates to encapsulated fuses for shielded power distribution systems.

BACKGROUND OF THE INVENTION

Now more than ever, electric utility power distribution systems are being constructed underground. Underground systems pose new operational and maintenance challenges by virtue of being largely unseen. In response to these challenges, organizations such as the Institute of Electrical and Electronics Engineers (IEEE) and the American National Standards Institute (ANSI) have implemented standards and codes to insure operating personnel safety and proper system performance. One such standard recommends the grounding (i.e., shielding) of individual underground distribution system components at multiple system points (e.g., cable splices, transformers, switches). Grounding system components (or their enclosures) helps eliminate accessibility to hazardous voltages by operating personnel.

Fuses are well known for use in power distribution systems for reliable interruption of fault current where reclosing is not required. When used in underground applications such as direct burial, switchgear, or vaults where there is a high probability of submersion, it is desirable for fuses to be compact and enclosed or encapsulated in electrically insulating, high dielectric strength material. To ground an underground fuse in order to protect personnel from hazardous voltages, the entire exterior must be conductive, producing a ground plane thereon. As a result, steep voltage gradients throughout the insulating material of the fuse are formed. The high system voltages present in the fuse are separated from the ground plane by a relatively thin insulating material. Under these conditions there is a tendency for the fuse to become electrically stressed and corona to discharge or arc within the fuse (e.g., discharge through the insulating material from the high voltage fusible element to the exterior ground plane). After the fuse has been subjected to such corona discharge for a long period of time, the fusible elements can be damaged and may not operate properly under short circuit or fault-interrupting conditions.

In order to mitigate corona discharge within the fuse, high voltage stress to the fusible elements must be eliminated. One established method to eliminate the high voltage stress inside the fuse is to envelope the fuse with a conductive surface that is at the same potential as the fusible element. This method of enveloping the fuse finds support in the Faraday Cage theory in which a conductive enclosure acts as a shield against electric fields and electromagnetic waves. Previous attempts to enclose the fuse have focused on applying a conductive or semiconductive coating such as paint to the fuse exterior surface. Although the applied coating may help eliminate voltage stress, often the coating provides fault current with a secondary conductive path (e.g., flashover) during a "blown" fuse condition thereby rendering the fuse useless.

Effective elimination of corona in encapsulated fuses for power distribution systems has been elusive. In view of the foregoing, it would be desirable to provide an encapsulated fuse that resists both corona discharge and flashover.

BRIEF SUMMARY OF THE INVENTION

An encapsulated fuse for power distribution systems is provided. The fuse includes a cylindrical body with opposing terminals. A corona shield is generally cylindrical and coaxial with the fuse and substantially extends the full length of the cylindrical fuse body. The corona shield is electrically coupled at its first end with a first fuse terminal. The second end of the corona shield has a slightly larger diameter than the first end and is electrically isolated from the second fuse terminal. The fuse and attached corona shield are then direct molded in an encapsulating material.

DETAILED DESCRIPTION OF THE EXEMPLARY EMBODIMENTS

Figure 1:
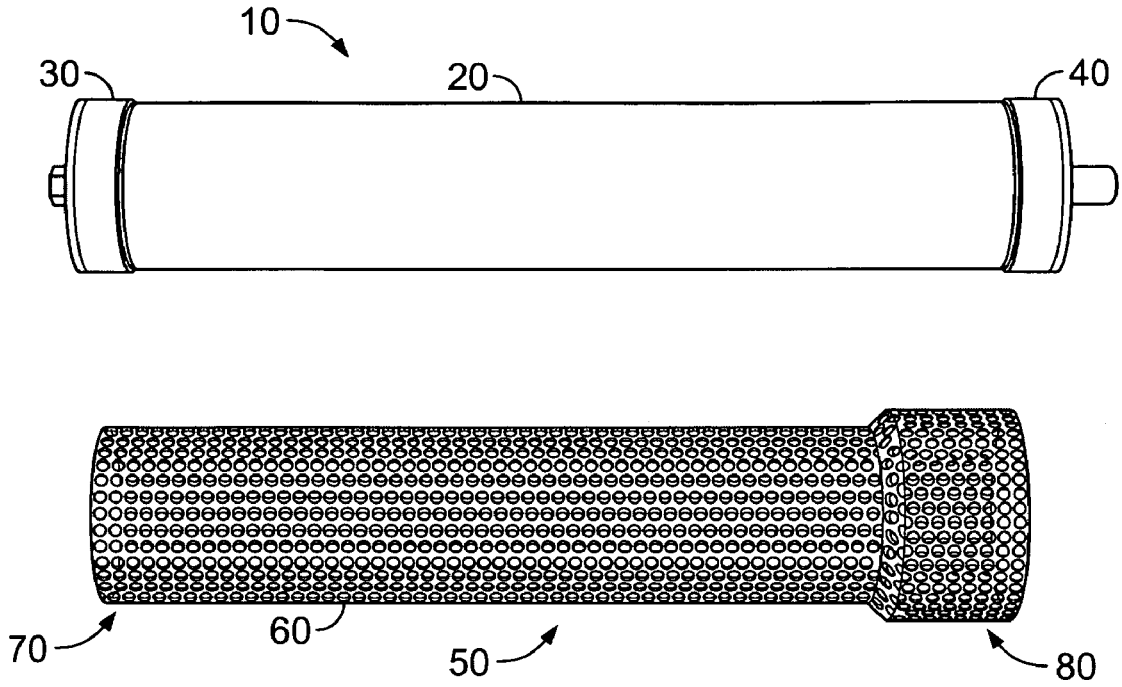
FIG. 1 illustrates an exemplary embodiment of a corona shield and an exemplary fuse.

Referring now to the Figures and particularly FIG. 1 an exemplary current limiting fuse 10 is shown. The fuse 10 includes a cylindrical body 20, a first fuse endcap terminal 30 and a second fuse endcap terminal 40. The fuse body 20 encloses a fusible element that electrically connects the first terminal 30 to the second terminal 40. The fuse body 20 may be made of a fiberglass or dielectric material whereas the terminals 30, 40 are conductive. As known in the art, one of the terminals 30, 40 may be vented. When installed in a power distribution system one of the first and second terminals 30, 40 is connected to an electrical source such as a feeder and the other of the first and second terminals 30, 40 is connected to a load so that the fuse 10 completes an electrical circuit therebetween. With reference to the exemplary embodiments herein, terminal 40 may be vented and associated with the load, whereas terminal 30 is associated with the line (i.e., source), but the terminal venting and associated connections thereto may be otherwise. The fuse 10 operates to conduct current at or below its predetermined (i.e., steady state) current rating. Above the predetermined current rating of the fuse 10, the fusible element disconnects the first terminal 30 from the second terminal 40 by melting, gas extinguishing an arc or a combination thereof or other means known in the art, thereby opening the electric circuit. In this open state, the fuse 10 is referred to in the art as "blown". Depending on the ratings and time-current characteristics of the fuse 10, it may be used for various applications where circuit reclosing is not required including steady state overcurrent protection, fault protection, or both. Such current limiting fuses are well known for use in overhead and underground applications in power distribution systems.

Figure 4:
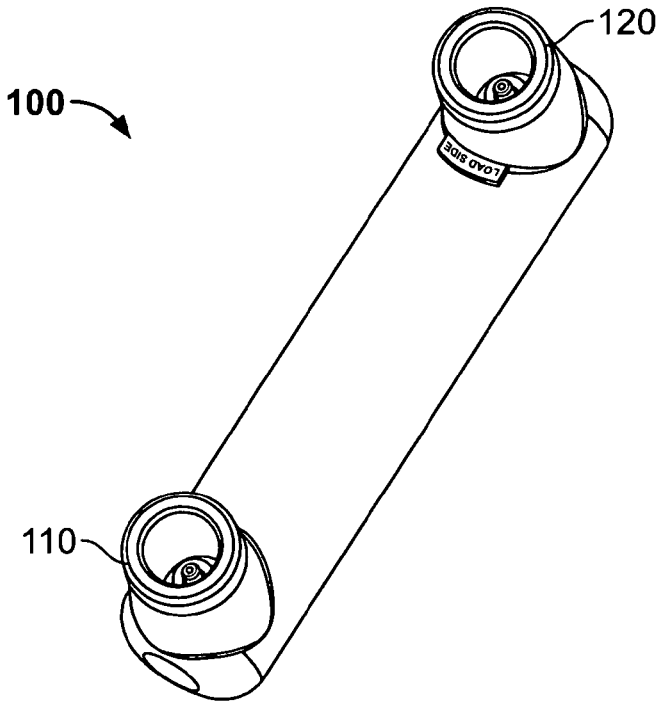
FIG. 4 illustrates a perspective view of an exemplary encapsulated fuse.

As is known in the art, for underground applications where submersion is probable such as direct burial, vaults and switchgear, the fuse 10 is preferably encapsulated such as in an environmental housing. An exemplary encapsulated fuse assembly 100 comprising the fuse 10 is illustrated in FIG. 4. To ensure the safety of operating personnel, the encapsulated fuse assembly 100 is shielded (i.e., grounded) by coating the outer surface of the encapsulation with a conductive or semiconductive layer (not shown). One exemplary coating for the fuse assembly 100 is Electrodag 502 semi-conductive paint available from the Acheson Colloids Company of Port Huron, Mich., but other suitable coatings may be employed. Thus, when the fuse assembly 100 is installed in a shielded distribution system the encapsulation outer surface provides a ground plane (i.e., is at ground potential). However, since the outer surface of the encapsulated fuse assembly 100 is at ground potential during fuse operation, the grounded surface, which is in close proximity to the fuse 10, causes voltage stresses inside the assembly 100 that may cause corona discharge and damage to the fusible element over time. To prevent corona discharge within the fuse assembly 100 a corona shield is provided.

Figure 2:
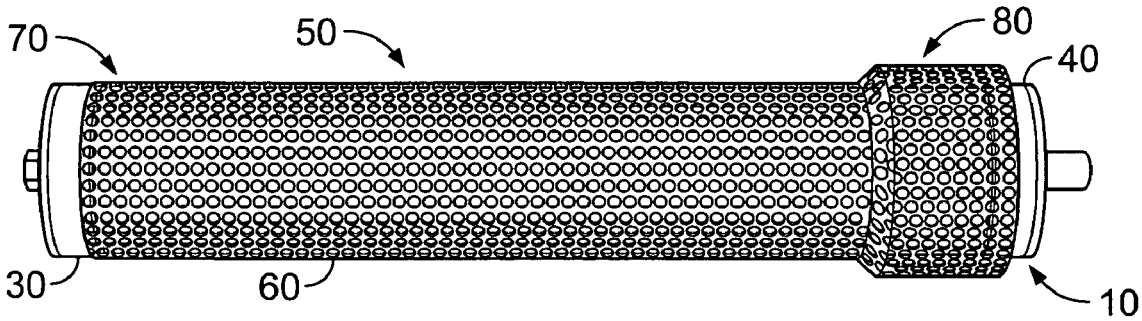
FIG. 2 illustrates the exemplary corona shield and fuse of FIG. 1 coupled together.

As shown in FIGS. 1 and 2 an exemplary corona shield 50 includes an elongated cylindrical body 60 which is adapted to substantially encompass the entire length of the fuse body 20. The corona shield 50 is metallic or otherwise conductive and includes a coupling end 70 and an opposing end 80. One exemplary shield 50 is formed of aluminum. The coupling end 70 has a substantially similar diameter as the fuse body 20 and terminals 30, 40 to couple therewith such as by a friction fit or the like. As shown in FIG. 2, the corona shield 50 is placed over the fuse 10 and is coaxial therewith. Although the fuse 10 and shield 50 are illustrated and described herein such that the coupling end 70 is attached with the first terminal 30 and the opposing end 80 is associated with the second terminal 40, this arrangement is not to be restrictive and may be reversed such that the coupling end 70 is attached to the second terminal 40 and the opposing end 80 is associated with the first terminal. The shield 50 may taper or flare slightly outward from the coupling end 70 to a point proximate the opposing end 80 to facilitate installation of the shield 50 onto the fuse 10.

Figure 3:
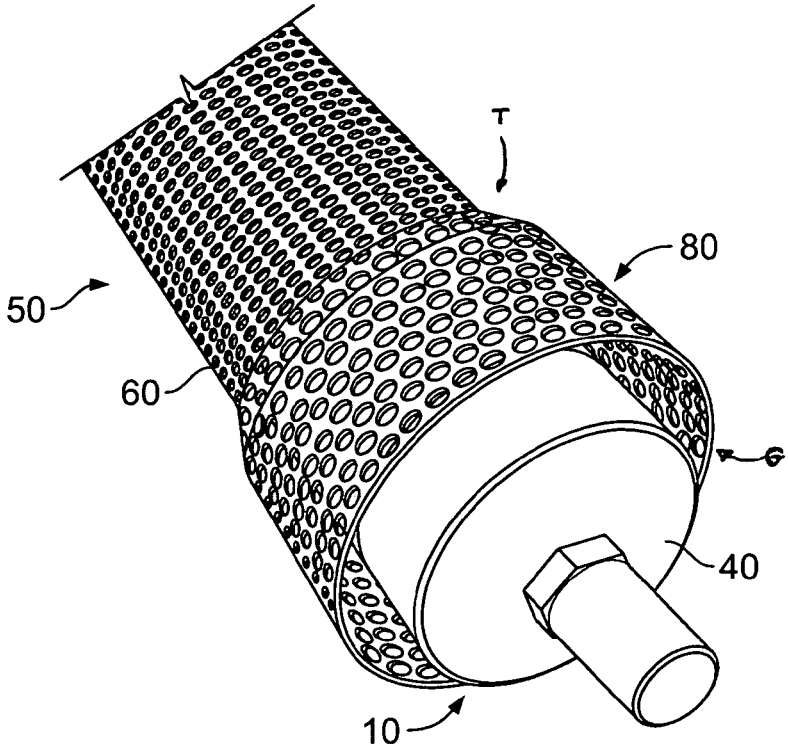
FIG. 3 is a perspective close-up view of FIG. 2 illustrating a radial gap between the fuse and corona shield.

The coupling end 70 of the shield 50 is attached to and in electrical contact with the first terminal 30 of the fuse, and the opposing end 80 bells out slightly from the diameter of the coupling end 70 to have a somewhat larger diameter than the fuse body 20 and terminals 30, 40. As best illustrated in FIG. 3, a radial gap G exists between the opposing end 80 of the corona shield 50 and the proximate fuse terminal 40. The coupling end 70 of the shield 50 may be attached to the first terminal 30 of the fuse by soldering, gluing, welding or other suitable means known in the art so that the shield 50 assumes the voltage potential of the first terminal 30. One exemplary attachment means is Epic S7076 manufactured by Epic Resins of Palmyra Wis. As is known, Epic S7076 is a carbon-filled, electrically conductive epoxy system that can be easily applied by hand or automatic dispensing equipment. Other electrically conductive epoxy systems may be suitably substituted.

As previously mentioned, the opposing end 80 of the shield 50 has a slightly larger diameter than the coupling end 70 and is radially spaced away from the second terminal 40 of the fuse 10. As shown in FIGS. 2 and 3, the coupling end 70 and opposing end 80 each axially overlap a portion of their respective terminals 30, 40 so that the fuse body 20 is encompassed by the shield 50. In one exemplary embodiment, the length of the shield 50 is slightly longer than the fuse body 20 so that when the coupling end 70 is attached to the terminal 30 the opposing end 80 of the shield 50 overlaps a portion of the second terminal 40 proximate the fuse body 20 by approximately a quarter of an inch. By substantially encompassing the fuse body 20 with a conductive element, steep voltage gradients and corona discharge are prevented since the shield 50 is at the same potential as the fuse element. Additionally, the axial portion T (FIG. 3) of the shield 50, which is proximate the opposing end 80, transitions from a first diameter to a second diameter in a curved or otherwise smooth manner. In this way, the transition portion T further obviates corona discharge, which is known to generally occur near sharp edges and abrupt transitions.

As shown in FIG. 2, the corona shield 50 may be formed from a perforated metallic sheet so that dielectric material such as viscous epoxy or the like may flow freely around and through the shield 50 during the encapsulation/molding process. Alternatively, the shield 50 may be a metallic screen or mesh material suitable to withstand the molding process. As can be appreciated from FIGS. 3 and 4, when the combination fuse 10 and shield 50 is fully encapsulated, the second terminal 40 of the fuse 10 is radially isolated from the opposing end 80 of the shield by a generally annular portion of the dielectric encapsulation material that fills the gap G. Since the encapsulation has a high dielectric withstand capability, the annular dielectric portion between the isolated end 80 and the second terminal 40 operates to prevent flashover when the fuse 10 is blown.

Figure 5:
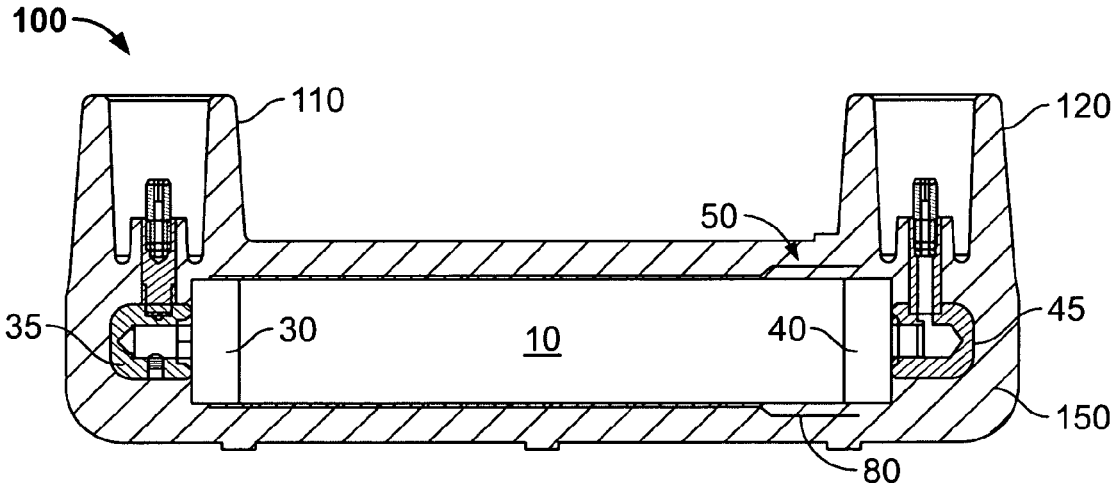
FIG. 5 illustrates a side cross-sectional side view of the exemplary encapsulated fuse of FIG. 4.

The exemplary fuse assembly 100 may be formed or cast in a mold to have bushings 110, 120 (FIG. 4) oriented generally perpendicular to the lengthwise body of the assembly 100 to facilitate connections with the line (i.e., source) and load, but other molds may provide for other suitable shapes of the fuse assembly 100. To this end, as shown in FIG. 5, adapters 35, 45 such as right angle connectors may be coupled with the terminals 30, 40 to provide the electrical connections for bushings 110, 120. One or more of the adapters 35, 45 may be vented as required relative to the venting of the terminals 30, 40. As can be appreciated from FIG. 5, the housing 150 is cast in one piece about the fuse 10 and corona shield 50. As is known, the fuse 10 and corona shield 50 are disposed in a mold and a resin, epoxy or other viscous dielectric material is introduced. Provisions are made in the mold so that electrical connections to the terminals 30, 40 and/or adapter 35, 45 are not impeded by the dielectric housing 150. One exemplary process for producing the assembly 100 includes the steps of: cleaning the shield 50 and fuse 10 exterior by sandblasting; coupling the shield 50 to the fuse 10 by applying an electrically conductive adhesive; coupling the fuse adapters 34, 45 to the fuse 10 terminals 30, 40; disposing the fuse 10 and coupled shield 50 into a mold; and casting the assembly 100 with a viscous dielectric material. Thereafter, a coating of a semi-conductive or conductive material may be applied to the exterior surface of the fuse assembly 100.

Exemplary embodiments of this invention are described herein. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fuse assembly that reduces corona shield discharge comprising:

a fuse having a first terminal, a second terminal, and a current conducting fusible element disposed therebetween and electrically connecting the first terminal and the second terminal, wherein the fusible element is configured to fail upon conducting current that exceeds a predetermined current rating and upon such failure electrically disconnect the first terminal from the second terminal;

a single electrically conductive member configured to be coupled with and disposed about the fuse, wherein the single electrically conductive member is electrically connected with the first terminal, and electrically isolated from the second terminal when the current conducting fusible element has failed and the first terminal is electrically disconnected from the second terminal as a result thereof;

wherein the single electrically conductive member includes a first end having a first diameter, a second end having a second diameter larger than the first diameter, and a conical transition portion positioned between the first end and the second end;

an electrically insulating housing encapsulating the conductive member and the fuse; and an electrically conductive or semi-conductive material disposed about the electrically conductive housing and configured to provide a ground plane for the fuse assembly.

2. The assembly of claim 1 wherein the single electrically conductive member is generally cylindrical.

3. The assembly of claim 2 wherein the electrically conductive member comprises a first diameter greater than a diameter of the fuse and a second diameter greater than the first diameter.

4. The assembly of claim 1 wherein the single electrically conductive member comprises a metallic sheet.

5. The assembly of claim 1 wherein the metallic sheet is perforated.

6. The assembly of claim 1 wherein the single electrically conductive member comprises a metallic mesh.

7. The assembly of claim 1 wherein the single electrically conductive member comprises a metallic screen.

8. The assembly of claim 1 wherein the electrically conductive member axially overlaps the first or the second terminal.

9. The assembly of claim 1 wherein the housing comprises a one-piece material.

10. The assembly of claim 1 wherein the single electrically conductive member comprises aluminum.

11. The fuse assembly comprising:

a fuse having a first terminal, a second terminal, and a current conducting fusible element disposed therebetween and electrically connecting the first terminal and the second terminal, wherein the fusible element is configured to fail upon conducting current that exceeds a predetermined current rating and upon such failure electrically disconnect the first terminal from the second terminal;

a single electrically conductive member substantially surrounding and coupled with the fuse;

a one-piece electrically isolating enclosure substantially encapsulating the fuse and the single electrically conductive member such that the single electrically conductive member is electrically connected with the first terminal of the fuse, and electrically isolated from the second terminal when the current conducting fusible element has failed and the first terminal is electrically disconnected from the second terminal of the fuse as a result thereof; and wherein the single electrically conductive member includes a first end having a first diameter, a second end having a second diameter larger than the first diameter, and a conical transition portion positioned between the first end and the second end;

an electrically conductive or semiconductor material disposed about the electrically isolating enclosure member.

12. The assembly of claim 11 wherein the single electrically conductive member is generally cylindrical and coaxial with the fuse.

13. The fuse assembly as claimed in claim 11, wherein the single electrically conductive member has a length and a cross-sectional area that is substantially the same along a majority of the length.

14. The fuse assembly as claimed in claim 13, wherein a second end of the single electrically conductive member at least partially overlaps the second terminal.

15. The fuse assembly as claimed in claim 13, wherein the single electrically conductive member includes a transition portion between a first end and the second end, the transition portion having a cross-sectional area that increases gradually from the first end to the second end.

* * * * *